US006472359B1

(12) United States Patent
Ghosh

(10) Patent No.: US 6,472,359 B1
(45) Date of Patent: Oct. 29, 2002

(54) LAUNDRY DETERGENT COMPOSITIONS COMPRISING ZWITTERIONIC POLYAMINES AND XYLOGLUCANASE

(75) Inventor: Chanchal Kumar Ghosh, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 33 days.

(21) Appl. No.: 09/790,044

(22) Filed: Feb. 21, 2001

Related U.S. Application Data

(60) Provisional application No. 60/184,367, filed on Feb. 23, 2000.

(51) Int. Cl.[7] ..... C11D 1/83; C11D 3/26; C11D 3/20; C11D 3/386

(52) U.S. Cl. ..... 510/321; 510/338; 510/340; 510/351; 510/356; 510/357; 510/360; 510/373; 510/504; 510/530; 562/107

(58) Field of Search ..... 510/321, 338, 510/340, 351, 356, 357, 360, 373, 504, 530; 562/107

(56) References Cited

U.S. PATENT DOCUMENTS

| | | | | |
|---|---|---|---|---|
| 5,914,443 A | | 6/1999 | Kalum | |
| 6,121,226 A | * | 9/2000 | Gosselink et al. | 510/400 |
| 6,191,093 B1 | * | 2/2001 | Watson et al. | 510/400 |
| 6,291,415 B1 | * | 9/2001 | Watson et al. | 510/400 |

FOREIGN PATENT DOCUMENTS

| | | |
|---|---|---|
| WO | WO 98/50513 A1 | 11/1998 |
| WO | WO 99/02663 A1 | 1/1999 |
| WO | WO 00/42146 A1 | 7/2000 |

* cited by examiner

*Primary Examiner*—Gregory Delcotto
(74) *Attorney, Agent, or Firm*—Richard S. Echler Sr.; Kim W. Zerby

(57) ABSTRACT

The present invention solves the problem of soil and dirt becoming entrained in cellulosic material loosened and removed from fabric during washing wherein said dirt and soil is entrapped by the cellulosic material and re-deposited onto the fabric surface. The compositions of the present invention comprise:

a) from about 0.01% by weight, of a zwitterionic polyamine which comprises a polyamine backbone, said backbone comprising two or more amino units wherein at least one of said amino units is quaternized and wherein at least one amino unit is substituted by one or more moieties capable of having an anionic charge wherein further the number of amino unit substitutions which comprise said anionic moiety is less than or equal to the number of quaternized backbone amino units;

b) from about 0.00005% by weight, of a xyloglucanase enzyme;

c) from about 0.5% to about 50% by weight, of a surfactant system comprising:

i) from about 10% to about 99% by weight, of said surfactant system, of a nonionic surfactant;

ii) from about 1% to about 90% by weight, of said surfactant system, of an anionic surfactant;

iii) optionally, from 1% to about 50% by weight, of said surfactant system, of a detersive surfactant selected from the group consisting of cationic surfactants, zwitterionic surfactants, ampholytic surfactants, and mixtures thereof; and d) the balance carriers and adjunct ingredients.

12 Claims, No Drawings

LAUNDRY DETERGENT COMPOSITIONS COMPRISING ZWITTERIONIC POLYAMINES AND XYLOGLUCANASE

CROSS REFERENCE

This Application claims the benefit of U.S. Provisional Application No. 60/184,367, filed on Feb. 23, 2000

FIELD OF THE INVENTION

The present invention relates to laundry detergent compositions which prevent the re-deposition of soil onto fabric which has been entrained into cellulosic material derived form fabric or other source. The surprising results are obtained from the combination of a zwitterionic polyamine and an enzyme system which comprises a xyloglucanase enzyme, preferably a xyloglucanase enzyme and a mannanase enzyme.

BACKGROUND OF THE INVENTION

Enzymes are now routinely comprise laundry detergent compositions. The variability of stains and soils is now effectively matched with one or more correspondingly effective enzymes. Proteinaceous stains are removed by protease enzymes while cellulase enzymes are used to obliterate and remove cellulosic material based stains and soils.

Regardless of how effective enzymes are at breaking up specific soils and providing a means for the removal of said stains from fabric, enzymes themselves can not serve to abate the re-deposition of soils back onto fabric itself. Enzymes which are effective at cutting the chemical bonds of the primary cell wall of cellulosic fabric are able to release entrapped soils for removal by surfactants. However, much of the xyloglucan comprising primary cell wall of cellulose comprising fibers is damaged due to mechanical wear either outside the laundry process or during laundering itself. The broken fiber material is finally loosened and removed during the mechanical wash, however this material can attract loosened soils and dirt, form an amorphous material which then re-deposits onto fabric.

There is a long felt need for a laundry detergent which is capable of breaking down loosened cellulosic material which entraps and re-deposits soil onto fabric. There is also a long felt need for an enzyme system which will maintain cellulosic fabric in a manner which abates the entrapping and embedding of soils which can be acted upon by other enzymes, inter alia, protease enzymes.

SUMMARY OF THE INVENTION

The present invention meets the aforementioned needs in that it has been surprisingly discovered that liquid laundry detergent compositions comprising a combination of xyloglucanase enzymes and one or more zwitterionic polyamines produces enhance soil removal properties. It has also been surprisingly discovered that a preferred enzyme system according to the present invention comprises a mixture xyloglucanase and mannanase enzymes, preferably in combination with one or more other detersive enzymes. It has also been surprisingly discovered that the formulator may selected the final pH of said compositions from about pH 7.2 to about pH 9.

The first aspect of the present invention relates to liquid laundry detergent compositions which comprise:

a) from about 0.01%, preferably from about 0.1%, more preferably from about 0.5%, most preferably form about 1% to about 10%, preferably to about 5%, more preferably to about 3%, most preferably to about 2% by weight, of a zwitterionic polyamine which comprises a polyamine backbone, said backbone comprising two or more amino units wherein at least one of said amino units is quaternized and wherein at least one amino unit is substituted by one or more moieties capable of having an anionic charge wherein further the number of amino unit substitutions which comprise said anionic moiety is less than or equal to the number of quaternized backbone amino units;

b) from about 0.00005%, preferably form about 0.0001% to about 0.005%, preferably to about 0.001% by weight, of a xyloglucanase enzyme;

c) from about 0.5% to about 50% by weight, of a surfactant system comprising:
   i) from about 10% to about 99% by weight, of said surfactant system, of a nonionic surfactant;
   ii) from about 1% to about 90% by weight, of said surfactant system, of an anionic surfactant;
   iii) optionally, from 1% to about 50% by weight, of said surfactant system, of a detersive surfactant selected from the group consisting of cationic surfactants, zwitterionic surfactants, ampholytic surfactants, and mixtures thereof, and d) the balance carriers and adjunct ingredients.

The present invention also relates to enzyme systems comprising:

i) from about 20% to about 99% by weight, of a said enzyme system, a xyloglucanase enzyme;
ii) from about 1% to about 80% by weight, of said enzyme system, a mannanase enzyme;
iii) optionally, from 1% to 80% by weight, of said enzyme system one or more enzymes selected from the group consisting of protease enzymes, amylase enzymes, cellulase enzymes, lipolase enzymes, lipase enzymes, peroxidase enzymes, cutinase enzymes, and mixtures thereof.

The present invention further relates to a method for treating fabric with an aqueous solution of a xyloglucanase enzyme containing liquid laundry detergent composition wherein the aqueous concentration of said xyloglucanase is from about 0.5 ppm to about 50 ppm, wherein said composition further comprises one or more zwitterionic polyamines.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

The present invention relates to liquid laundry detergent compositions which have enhanced soil removal benefits. The combination of a xyloglucanase enzyme with a zwitterionic polyamine dispersant provides soil removal from cellulosic fabric and improved soil anti-redeposition properties. The present invention prevents the entrapment of soils into residues which can be re-deposited onto fabric.

Without wishing to be limited by theory, cellulosic fabric comprises fibers wherein xylogluncan is a primary cell wall constituent. The primary cell wall (outer layer of fiber) is damaged due to abrasion from wear the fabric and is also damaged by the enzymes which comprise detergent compositions, inter alia, cellulases. The xyloglucan cellular material which comprises a piece of cellulosic fabric may become loosened or detached due to these circumstances and during the laundering process several pejorative consequences to fabric cleaning can result. In one case the loosened and detachable xyloglucan is lifted from the surface of fabric. This amorphous, glue-like material is usually large enough in molecular weight that is not easily solublized or dispersed, but instead, is present along the fabric surface where it can entrain loosened or removed soil. Once the amorphous xyloglucan containing material is contaminated with soil, it has a propensity to re-deposit onto the surface of fabric thereby producing an entrapped area of soil.

Alternatively, long strings of xyloglucan polymer can become semi-detached from the cellulosic fabric primary cell wall and this glue-like material in turn can entrap soils which have been removed from the fabric surface. In addition, other enzymes which are present, protease enzymes, inter alia, may produce fragments of foreign stain material which, instead of being carried away by the laundry liquor, become immediately imbedded within the amorphous xyloglucan strands.

It has now been surprisingly discovered that the presence of xyloglucanase enzyme together with a fabric surface active zwitterionic polyamine inhibits the entrapment of soils and stain material by xyloglucan cell wall fragments. During the laundry process, xyloglucanase enzymes cut the xyloglucan fragments completely free of the cellulosic primary cell wall thereby providing a virtually renewed fiber surface. In addition, the xyloglucanase enzymes react with the amorphous, glue-like material and produce a water soluble or dispersible material which is incapable of re-depositing onto fabric or incapable of entrapping soil or stain material.

It has also been surprisingly discovered that in some instances liquid laundry detergent compositions which comprise an enzyme system wherein a mannanase enzyme is formulated in combination with a xyloglucanase enzyme produce an enhanced cleaning effect.

The following is a description of the essential elements of the present invention.

Zwitterionic Polyamines

The zwitterionic polyamines of the present invention comprise from about 0.01%, preferably from about 0.1%, more preferably from about 0.5%, most preferably form about 1% to about 10%, preferably to about 5%, more preferably to about 3%, most preferably to about 2% by weight, of the final laundry detergent composition. The zwitterionic polymers of the present invention are suitable for use in liquid laundry detergent compositions, inter alia, gels, thixotropic liquids, and pourable liquids (i.e., dispersions, isotropic solutions).

It has been surprisingly discovered that the formulator, by selecting the relative degree of quaternization of the polyamine backbone, the type and relative degree of incorporation of anionic units which substitute the polyamine backbone, and the nature of the amine backbone itself, is able to form a zwitterionic polymer which can be tailored for optimal effectiveness in a compositions comprising a xyloglucanase enzyme or an enzyme system which comprises a xyloglucanase enzyme. Therefore, key to the selection of properties which affects optimization is the desired execution. Preferably, as described herein below, the zwitterionic polymers which are incorporated into xyloglucanase containing liquid laundry detergent compositions have an excess number of quaternized backbone nitrogens relative to the number of anionic units which are present.

For the purposes of the present invention the term "charge ratio", $Q_r$, is defined herein as "the quotient derived from dividing the sum of the number of anionic units present excluding counter ions by the sum of the number of quaternary ammonium backbone units". The charge ratio is defined by the expression:

$$Q_r = \frac{\sum q_{anionic}}{\sum q_{cationic}}$$

wherein $q_{anionic}$ is an anionic unit, inter alia, —$SO_3M$, as defined herein below and $q_{cationic}$ represents a quaternized backbone nitrogen.

Those of skill in the art will realize that the greater the number of amine units which comprise the polyamine backbones of the present invention the greater the number of potential cationic units will be contained therein. For the purposes of the present invention the term "degree of quaternization" is defined herein as "the number of backbone units which are quaternized divided by the number of backbone units which comprise the polyamine backbone". The degree of quaternization, Q(+), is defined by the expression:

$$Q(+) = \frac{\sum \text{quaternized backbone nitrogens}}{\sum \text{quaternizable backbone nitrogens}}$$

wherein a polyamine having all of the quaternizable backbone nitrogens quaternized will have a Q(+) equal to 1. For the purposes of the present invention the term "quaternizable nitrogen" refers to nitrogen atoms in the polyamine backbone which are capable of forming quaternary ammonium ions. This excludes nitrogens not capable of ammonium ion formation, inter alia, amides.

For the purposes of the present invention the term "anionic character", ΔQ, is defined herein as "the sum of the number of anionic units which comprise the zwitterionic polymer minus the number or quaternary ammonium backbone units". The greater the excess number of anionic units, the greater the anionic character of the zwitterionic polymer. It will be recognized by the formulator that some anionic units may have more than one unit which has a negative charge. For the purposes of the present invention units having more than one negatively charged moiety, —$CH_2CH(SO_3M)CH_2SO_3M$, inter alia, will have each moiety capable of having a negative charge counted toward the sum of anionic units. The anionic character is defined by the expression:

$$\Delta Q = \Sigma q_{anionic} - q_{cationic}$$

wherein $q_{anionic}$ and $q_{cationic}$ are the same as defined herein above.

As described herein below, a key aspect of the present invention is the finding that the formulator, by adjusting the parameters $Q_r$, ΔQ, and Q(+), will be capable of customizing a polymer to formulate liquid laundry detergent compositions having enhanced particulate soil removal benefits throughout a wide variety of settings, for example as a function of (1) the nature of the polymeric structure itself (e.g., EO level, MW, length and HLB of the amine backbone, etc.), (2) the detergent matrix (e.g., pH, type of surfactant), (3) the particular embodiment (e.g., liquids, gel, structured liquid, non-aqueous, etc.), and (4) desired benefit (e.g., clay stain removal, whiteness, dingy cleaning, etc.). Therefore, in one desired embodiment the zwitterionic polymers of the present invention may have a $Q_r$ of from about 1 to about 2, whereas another embodiment will employ zwitterionic polymers having a $Q_r$ greater than 2. Specific embodiments, as described herein below, may require a $Q_r$ significantly less than 1 or even zero.

Liquid laundry detergent compositions may comprise clay soil dispersants which adsorb on the anionic surfaces of dislodged clay particles and form a stabilized suspension of the particles and hold the particles in solution until they are removed during the rinsing process thus preventing the particles from re-depositing upon the fabric surface. An example of preferred hydrophilic dispersants which are further described herein below, is a dispersant which comprises a polyethyleneimine backbone having an average molecular weight of about 189 daltons and in which each nitrogen which comprises said backbone has the appended hydrogen atom replaced by an ethyleneoxy unit having from 15 to 18 residues on average. This preferred ethoxylated polyethyleneimine dispersant is herein after referred to as PEI 189 E15-18. This dispersant is highly effective in dispersing clay soils once the clay soils are removed from fabric.

Subtle changes to the structure of polyalkyleneimines can provide profound changes to the properties thereof. For example, a preferred hydrophobic dispersant capable of dispersing soot, grime, oils, carbonaceous material, comprises a polyethyleneimine having a backbone with an average molecular weight of about 1800 daltons and in which each nitrogen which comprises said backbone has the appended hydrogen atom replaced by an ethyleneoxy unit having from about 0.5 to about 10 residues on average, preferably an average of 7 residues, for example, PEI 1800 E7. The ability to affect profound changes in the properties of polyamines by making small changes to the structure of said polyamines is known and appreciated throughout the laundry art.

Knowing the propensity of these polyamines to exhibit activity in the aqueous laundry liquor, it is therefore surprising and highly unexpected that zwitterionic polyamines having hydrophilic backbone components would act synergistically with certain mid-chain branched surfactants to enhance the removal of clay and other hydrophilic soils directly from fabric fiber itself. Without wishing to be bound by theory it is believed the zwitterionic polyamines of the present invention interact with the mid-chain branched surfactants in a manner which makes clay and other cationic surfaces more anionic in nature. It is believed this system absorbs the modified clay particles from the fiber surface and the inherent agitation associated with the laundry process (for example, the agitation provided by an automatic washing machine) acts to break the once formed complexes loose from the fabric surface and disperse them into solution. The clay and other hydrophilic particles which are removed by the compositions of the present invention are those types of stains or particles which are not well removed by normal surfactant/dispersant systems.

Although other surfactants, inter alia, non mid-chain branched sulphonates and sulphates, nonionic surfactants, are highly desirable components of the herein described granular laundry detergent compositions, their absence or presence does not affect the ability of the zwitterionic polyamine/mid-chain branched surfactant system to enhance clay soil removal.

The zwitterionic polymers of the present invention are comprised of a polyamine backbone wherein the backbone units which connect the amino units can be modified by the formulator to achieve varying levels of product enhancement, inter alia, boosting of clay soil removal by surfactants, greater effectiveness in high soil loading usage. In addition to modification of the backbone compositions, the formulator may preferably substitute one or more of the backbone amino unit hydrogens by other units, inter alia, alkyleneoxy units having a terminal anionic moiety. In addition, the nitrogens of the backbone may be oxidized to the N-oxide. Preferably at least two of the nitrogens of the polyamine backbones are quaternized.

For the purposes of the present invention "cationic units" are defined as "units which are capable of having a positive charge". For the purposes of the zwitterionic polyamines of the present invention the cationic units are the quaternary ammonium nitrogens of the polyamine backbones. For the purposes of the present invention "anionic units" are defined as "units which are capable of having a negative charge". For the purposes of the zwitterionic polyamines of the present invention the anionic units are "units which alone, or as a part of another unit, substitute for hydrogens along the polyamine backbone" a non-limiting example of which is a $—(CH_2CH_2O)_{20}SO_3Na$ which is capable of replacing a backbone hydrogen on a nitrogen or oxygen atom.

The zwitterionic polyamines of the present invention have the formula:

$$[J—R]_n—J$$

wherein the [J—R] units represent the amino units which comprise the main backbone and any branching chains. Preferably the zwitterionic polyamines prior to modification, inter alia, quaternization, substitution of a backbone unit hydrogen with an alkyleneoxy unit, have backbones which comprise from 2 to about 100 amino units. The index n which describes the number of backbone units present is further described herein below.

J units are the backbone amino units, said units are selected from the group consisting of:

i) primary amino units having the formula:

$$(R^1)_2N;$$

ii) secondary amino units having the formula:

$$—R_1N;$$

iii) tertiary amino units having the formula:

$$\begin{array}{c} B \\ | \\ —N; \end{array}$$

iv) primary quaternary amino units having the formula:

$$\begin{array}{c} (R^1)_2\overset{+}{N} \\ | \\ Q; \end{array}$$

v) secondary quaternary amino units having the formula:

$$\begin{array}{c} —R^1\overset{+}{N} \\ | \\ Q; \end{array}$$

vi) tertiary quaternary amino units having the formula:

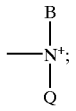

vii) primary N-oxide amino units having the formula:

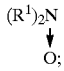

viii) secondary N-oxide amino units having the formula:

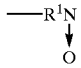

ix) tertiary N-oxide amino units having the formula:

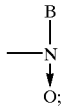

x) and mixtures thereof.

B units which have the formula:

[J—R]— represent a continuation of the zwitterionic polyamine backbone by branching. The number of B units present, as well as, any further amino units which comprise the branches are reflected in the total value of the index n.

The backbone amino units of the zwitterionic polymers are connected by one or more R units, said R units are selected from the group consisting of:

i) $C_2$–$C_{12}$ linear alkylene, $C_3$–$C_{12}$ branched alkylene, or mixtures thereof; preferably $C_3$–$C_6$ alkylene. When two adjacent nitrogens of the polyamine backbone are N-oxides, preferably the alkylene backbone unit which separates said units are $C_4$ units or greater.

ii) alkyleneoxyalkylene units having the formula:

$$—(R^2O)_w(R^3)—$$

wherein $R^2$ is selected from the group consisting of ethylene, 1,2-propylene, 1,3-propylene, 1,2-butylene, 1,4-butylene, and mixtures thereof; $R^3$ is $C_2$–$C_8$ linear alkylene, $C_3$–$C_8$ branched alkylene, phenylene, substituted phenylene, and mixtures thereof; the index w is from 0 to about 25. $R^2$ and $R^3$ units may also comprise other backbone units. When comprising alkyleneoxyalkylene units $R^2$ and $R^3$ units are preferably mixtures of ethylene, propylene and butylene and the index w is from 1, preferably from about 2 to about 10, preferably to about 6.

iii) hydroxyalkylene units having the formula:

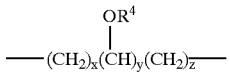

wherein $R^4$ is hydrogen, $C_1$–$C_6$ alkyl, $—(CH_2)_u(R^2O)_t(CH_2)_uY$, and mixtures thereof. When R units comprise hydroxyalkylene units, $R^4$ is preferably hydrogen or $—(CH_2)_u(R^2O)_t(CH_2)_uY$ wherein the index t is greater than 0, preferably from 10 to 30; the index u is from 0 to 6; and Y is preferably hydrogen or an anionic unit, more preferably $—SO_3M$. The indices x, y, and z are each independently from 1 to 6, preferably the indices are each equal to 1 and $R^4$ is hydrogen (2-hydroxypropylene unit) or $(R^2O)_tY$, or for polyhydroxy units y is preferably 2 or 3. A preferred hydroxyalkylene unit is the 2-hydroxypropylene unit which can, for example, be suitably formed from glycidyl ether forming reagents, inter alia, epihalohydrin.

iv) hydroxyalkylene/oxyalkylene units having the formula:

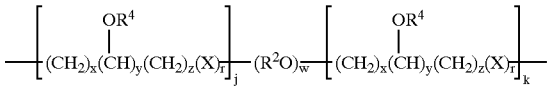

wherein $R^2$, $R^4$, and the indices w, x, y, and z are the same as defined herein above. X is oxygen or the amino unit $—NR^4—$, the index r is 0 or 1. The indices j and k are each independently from 1 to 20. When alkyleneoxy units are absent the index w is 0. Non-limiting examples of preferred hydroxyalkylene/oxyalkylene units have the formula:

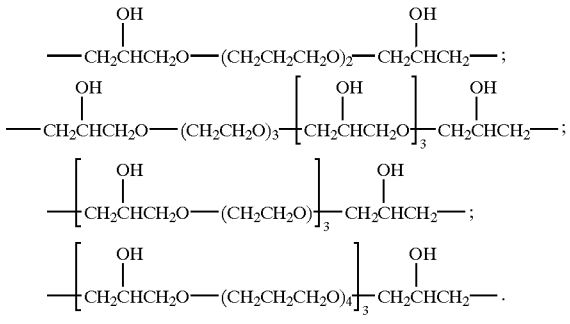

v) carboxyalkyleneoxy units having the formula:

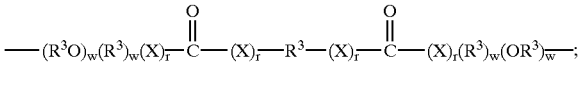

wherein $R^2$, $R^3$, X, r, and w are the same as defined herein above. Non-limiting examples of preferred carboxyalkyleneoxy units include:

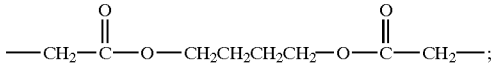

-continued

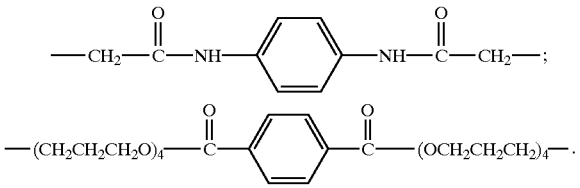

vi) backbone branching units having the formula:

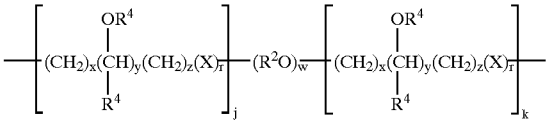

wherein $R^4$ is hydrogen $C_1$–$C_6$ alkyl, —$(CH_2)_u(R^2O)_t(CH_2)_uY$, and mixtures thereof. When R units comprise backbone branching units, $R^4$ is preferably hydrogen of —$(CH_2)_u(R^2O)_t$—$(CH_2)_uY$ wherein the index t is greater than 0, preferably from 10 to 30; the index u is from 0 to 6; and Y is hydrogen, $C_1$–$C_4$ linear alkyl, —$N(R^1)_2$, an anionic unit, and mixtures thereof; preferably Y is hydrogen, or —$N(R^1)_2$. A preferred embodiment of backbone branching units comprises $R^4$ equal to —$(R^2O)_tH$. The indices x, y, and z are each independently from 0 to 6.

vii) The formulator may suitably combine any of the above described R units to make a zwitterionic polyamine having a greater or lesser degree of hydrophilic character.

$R^1$ units are the units which are attached to the backbone nitrogens. $R^1$ units are selected from the group consisting of:

i) hydrogen; which is the unit typically present prior to any backbone modification.

ii) $C_1$–$C_{22}$ alkyl, preferably $C_1$–$C_4$ alkyl, more preferably methyl or ethyl, most preferably methyl. A preferred embodiment of the present invention in the instance wherein $R^1$ units are attached to quaternary units (iv) or (v), $R^1$ is the same unit as quaternizing unit Q. For example a J unit having the formula:

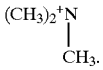

iii) $C_7$–$C_{22}$ arylalkyl, preferably benzyl.

iv) —$[CH_2CH(OR^4)CH_2O]_s(R^2O)_tY$; wherein $R^2$ and $R^4$ are the same as defined herein above, preferably when $R^1$ units comprise $R^2$ units, $R^2$ is preferably ethylene. The value of the index s is from 0 to 5. For the purposes of the present invention the index t is expressed as an average value, said average value from about 0.5 to about 100. The formulator may lightly alkyleneoxylate the backbone nitrogens in a manner wherein not every nitrogen atom comprises an $R^1$ unit which is an alkyleneoxy unit thereby rendering the value of the index t less than 1.

v) Anionic units as described herein below.

vi) The formulator may suitably combine one or more of the above described $R^1$ units when substituting the backbone of the zwitterionic polymers of the present invention.

Q is a quaternizing unit selected from the group consisting of $C_1$–$C_4$ linear alkyl, benzyl, and mixtures thereof, preferably methyl. As described herein above, preferably Q is the same as $R^1$ when $R^1$ comprises an alkyl unit. For each backbone $N^+$ unit (quaternary nitrogen) there will be an anion to provide charge neutrality. The anionic groups of the present invention include both units which are covalently attached to the polymer, as well as, external anions which are present to achieve charge neutrality. Non-limiting examples of anions suitable for use include halogen, inter alia, chloride; methyl sulfate; hydrogen sulfate, and sulfate. The formulator will recognize by the herein described examples that the anion will typically be a unit which is part of the quaternizing reagent, inter alia, methyl chloride, dimethyl sulfate, benzyl bromide.

X is oxygen, —$NR^4$—, and mixtures thereof, preferably oxygen.

Y is hydrogen, $C_1$–$C_4$ linear alkyl, —$N(R^1)_2$, or an anionic unit. Y is —$N(R^1)_2$ preferably when Y is part of an R unit which is a backbone branching unit. Anionic units are defined herein as "units or moieties which are capable of having a negative charge". For example, a carboxylic acid unit, —$CO_2H$, is neutral, however upon de-protonation the unit becomes an anionic unit, —$CO_2^-$, the unit is therefore, "capable of having a negative charge. Non-limiting examples of anionic Y units include —$(CH_2)_fCO_2M$, —$C(O)(CH_2)_fCO_2M$, —$(CH_2)_fPO_3M$, —$(CH_2)_fOPO_3M$, —$(CH_2)_fSO_3M$, —$CH_2(CHSO_3M)$—$(CH_2)_fSO_3M$, —$CH_2(CHSO_2M)(CH_2)_fSO_3M$, —$C(O)CH_2CH(SO_3M)CO_2M$, —$C(O)CH_2CH(CO_2M)NHCH(CO_2M)CH_2CO_2M$, —$C(O)CH_2CH(CO_2M)NHCH_2CO_2M$, —$CH_2CH(OZ)CH_2O(R^1O)_tZ$, —$(CH_2)_fCH[O(R^2O)_tZ]$—$CH_fO(R^2O)_tZ$, and mixtures thereof, wherein Z is hydrogen or an anionic unit non-limiting examples of which include —$(CH_2)_fCO_2M$, —$C(O)(CH_2)_fCO_2M$, —$(CH_2)_fPO_3M$, —$(CH_2)_fOPO_3M$, —$(CH_2)_fSO_3M$, —$CH_2(CHSO_3M)$—$(CH_2)_fSO_3M$, —$CH_2(CHSO_2M)(CH_2)_fSO_3M$, —$C(O)CH_2CH(SO_3M)CO_2M$, —$C(O)CH_2CH(CO_2M)NHCH(CO_2M)CH_2CO_2M$, and mixtures thereof, M is a cation which provides charge neutrality.

Y units may also be oligomeric or polymeric, for example, the anionic Y unit having the formula:

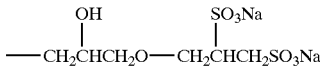

may be oligomerized or polymerized to form units having the general formula:

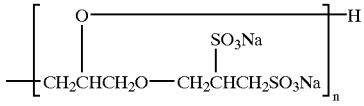

wherein the index n represents a number greater than 1.

Further non-limiting examples of Y units which can be suitably oligomerized or polymerized include:

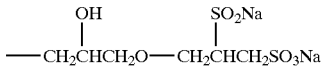

and

-continued $$-CH_2CH(OH)CH_2O-CH_2CH_2CH_2SO_3Na \quad \text{and}$$

$$-CH_2CH(OSO_3Na)CH_2O-CH_2CH_2CH_2OSO_3Na.$$

As described herein above that a variety of factors, inter alia, the overall polymer structure, the nature of the formulation, the wash conditions, and the intended target cleaning benefit, all can influence the formulator's optimal values for $Q_r$, $\Delta Q$, and Q(+). For liquid laundry detergent compositions preferably less than about 90%, more preferably less than 75%, yet more preferably less than 50%, most preferably less than 40% of said Y units comprise an anionic moiety, inter alia, —$SO_3M$ comprising units. The number of Y units which comprise an anionic unit will vary from embodiment to embodiment. M is hydrogen, a water soluble cation, and mixtures thereof; the index f is from 0 to 6

The index n represents the number of backbone units wherein the number of amino units in the backbone is equal to n+1. For the purposes of the present invention the index n is from 1 to about 99. Branching units B are included in the total number of backbone units. For example, a backbone having the formula:

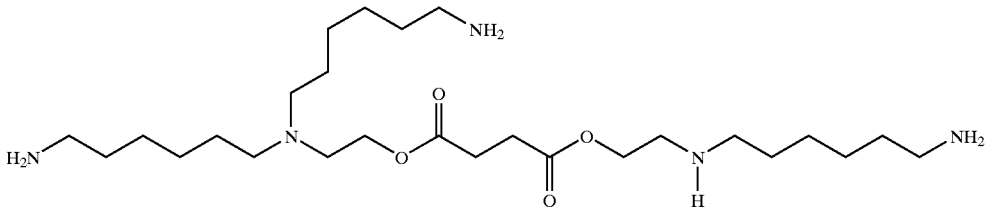

has an index n equal to 4. The following is a non-limiting example of a polyamine backbone which is fully quaternized.

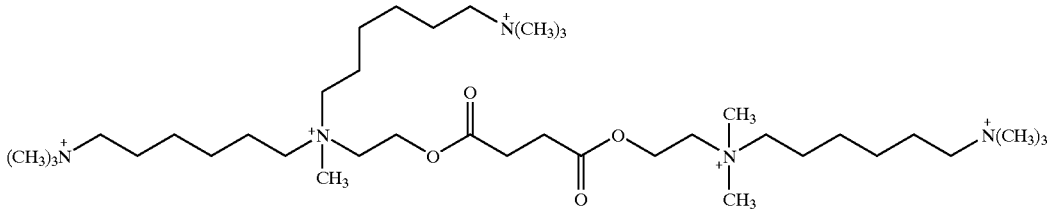

The following is a non-limiting example of a zwitterionic polyamine according to the present invention.

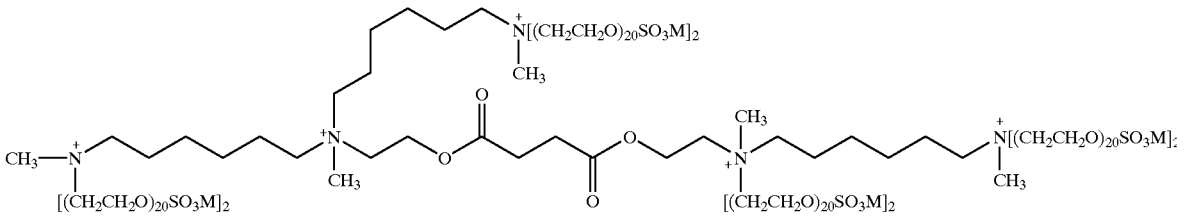

Preferred zwitterionic polymers of the present invention have the formula:

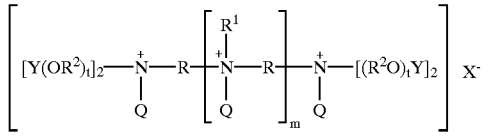

wherein R units are $C_3$–$C_6$ alkylene units, preferably R is hexamethylene; $R^1$ is hydrogen, Q, —$(R^2O)_tY$, and mixtures thereof, preferably —$(R^2O)_tY$; $R^2$ is ethylene, Y is hydrogen, an anionic unit selected from the group consisting of —$(CH_2)_fCO_2M$, —$C(O)(CH_2)_fCO_2M$, —$(CH_2)_fPO_3M$, —$(CH_2)_fOPO_3M$, —$(CH_2)_fOSO_3M$, —$(CH_2)_fSO_3M$, —$CH_2(CHSO_3M)(CH_2)_fSO_3M$, —$CH_2(CHSO_2M)(CH_2)_fOSO_3M$, —$CH_2(CHSO_2M)(CH_2)_fSO_3M$ and mixtures thereof; preferably Y is hydrogen, —$(CH_2)_fSO_3M$, and mixtures thereof. In a more preferred embodiment of the present invention at least 30% of Y units are anionic units having the formula —$SO_3M$. M is hydrogen, a water soluble cation, and mixtures thereof; the index f is from 0 to about 10; Q is a quaternizing unit selected from the group consisting of $C_1$–$C_4$ linear alkyl, benzyl, and mixtures thereof; preferably Q is methyl or benzyl, more preferably methyl. X is a water soluble anion in sufficient quantity to provide electronic neutrality. The index m is from 0 to 20; preferably m is less than 10; more preferably m has the value of 0, 1, 2, and 3 providing polyamines having from 2 to 5 backbone nitrogen atoms. In one preferred embodiment m is 0 and R is hexamethylene which provides a backbone which is a hexamethylenediamine. Bis(hexamethylenediamine) backbones, wherein m is equal to 1, are also a preferred. The index t represents an average value for alkyleneoxy units and varies from 15 to 25. In one embodiment the formulator may not tightly ethoxylate and the number of EO units may range fully from 15 to 25, whereas in another equally useful embodiment the variability in the range of ethoxylation may be from 18.5 to 21.5. However, the formulator may select a means for ethoxylation which wherein each $R^1$ unit comprises the same whole number of ethyleneoxy units.

Non-limiting examples of backbones according to the present invention include 1,9-diamino-3,7-dioxanonane; 1,10-diamino-3,8-dioxadecane; 1,12-diamino-3,10-dioxadodecane; 1,14-diamino-3,12-dioxatetradecane. However, backbones which comprise more than two nitrogens may comprise one or more repeating units having the formula:

$$H_2N—[R—NH]—$$

for example a unit having the formula:

$$H_2N—[CH_2CH_2OCH_2CH_2NH]—$$

is described herein as 1,5-diamino-3-oxapentane. A backbone which comprises two 1,5-diamino-3-oxapentane units has the formula:

$$H_2NCH_2CH_2OCH_2CH_2NHCH_2CH_2OCH_2CH_2NH_2.$$

ii) hydrophilic oligomers which comprise R units of type (ii), which are preferably polyamines having the formula:

$$H_2N—[(CH_2)_xO]_y(CH_2)_x]—[NH—[(CH_2)_xO]_y(CH_2)_x]_m—NH_2$$

wherein m is from 0 to 3; each x is independently from 2 to 8, preferably from 2 to 6; y is preferably from 1 to 8.

Preferred backbone units are the units from (i). Further preferred embodiments are polyamines which comprise units from (i) which are combined with R units of types (iii), (iv), and (v), an non-limiting example of which includes the epihalohydrin condensate having the formula:

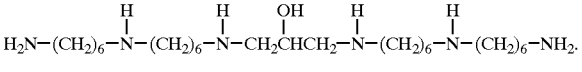

As described herein before, the formulator may form zwitterionic polymers which have an excess of charge or an equivalent amount of charge type. An example of a preferred zwitterionic polyamine according to the present invention which has an excess of backbone quaternized units, has the formula:

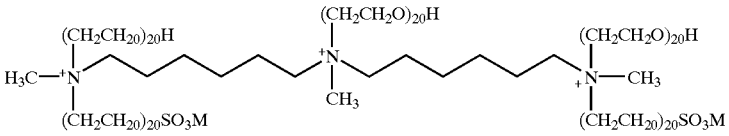

Further suitable repeating units include 1,8-diamino-3,6-diaxaoctane; 1,11-diamino-3,6,9-trioxaundecane; 1,5-diamino-1,4-dimethyl-3-oxaheptane; 1,8-diamino-1,4,7-trimethyl-3,6-dioxaoctane; 1,9-diamino-5-oxanonane; 1,14-diamino-5,10-dioxatetradecane.

The present invention affords the formulator with the ability to optimize the zwitterionic polymer for a particular use or embodiment. Not wishing to be limited by theory, it is believed that the backbone quaternization (positive charge carriers) interact with the hydrophobic soils, inter alia, clay, and the anionic capping units of the $R^1$ units ameliorate the ability of surfactant molecules to interact, and therefore occupy, the cationic sites of the zwitterionic polymers. It is surprisingly found that the liquid laundry detergent compositions (HDL) which encompass the present invention are more effective in releasing hydrophilic soils when the backbones which comprise R units have a greater degree of alkylene unit character and which comprise an excess of backbone quaternary units with respect to the number of anionic units present.

The zwitterionic polymers of the present invention preferably comprise polyamine backbone which are derivatives of two types of backbone units:

i) normal oligomers which comprise R units of type (i), which are preferably polyamines having the formula:

$$H_2N—(CH_2)_x]_{n+1}—[NH—(CH_2)_x]_m—[NB—(CH_2)_x]_n—NH_2$$

wherein B is a continuation of the polyamine chain by branching, n is preferably 0, m is from 0 to 3, x is 2 to 8, preferably from 3 to 6; and wherein R is a 1,5-hexamethylene, w is 2; $R^1$ is $—(R^2O)_tY$, wherein $R^2$ is ethylene, Y is hydrogen or $—SO_3M$, Q is methyl, m is 1, t is 20. For zwitterionic polyamines of the present invention, it will be recognized by the formulator that not every $R^1$ unit will have a $—SO_3$ moiety capping said $R^1$ unit. For the above example, the final zwitterionic polyamine mixture comprises at least about 40% Y units which are $—SO_3^-$ units.

EXAMPLE 1

Preparation of Bis(hexamethylene)triamine, Ethoxylated to Average E20 Per NH, Quaternized to 90%, and Sulfated to 35%

Ethoxylation of bis(hexamethylene)triamine The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide is set up to deliver ethylene oxide as a liquid by a pump to the autoclave with the cylinder placed on a scale so that the weight change of the cylinder could be monitored.

A 200 g portion of bis(hexamethylene)triamine (BHMT) (M.W. 215.39, high purity 0.93 moles, 2.8 moles N, 4.65 moles ethoxylatable (NH) sites) is added to the autoclave. The autoclave is then sealed and purged of air (by applying vacuum to minus 28" Hg followed by pressurization with nitrogen to 250 psia, then venting to atmospheric pressure). The autoclave contents are heated to 80° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned on and off and cooling is applied to limit any temperature increase resulting from any reaction exotherm. The temperature is maintained between 100 and 110° C. while the total pressure is allowed to gradually increase during the course of the reaction. After a total of 205 grams of ethylene oxide (4.65 moles) has been charged to the autoclave, the temperature is increased to 110° C. and the autoclave is allowed to stir for an additional 2 hours. At this point, vacuum is applied to remove any residual unreacted ethylene oxide.

Vacuum is continuously applied while the autoclave is cooled to about 50° C. while introducing 60.5 g of a 25% sodium methoxide in methanol solution (0.28 moles, to achieve a 10% catalyst loading based upon BHMT nitrogen functions). The methanol from the methoxide solution is removed from the autoclave under vacuum and then the autoclave temperature controller setpoint is increased to 100° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1.5 hours indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 3887 g of ethylene oxide (88.4 mol, resulting in a total of 20 moles of ethylene oxide per mol of ethoxylatable sites on BHMT), the temperature is increased to 110° C. and the mixture stirred for an additional 2 hours.

The reaction mixture is then collected into a 22 L three neck round bottomed flask purged with nitrogen. The strong alkali catalyst is neutralized by slow addition of 27.2 g methanesulfonic acid (0.28 moles) with heating (100° C.) and mechanical stirring. The reaction mixture is then purged of residual ethylene oxide and deodorized by sparging an inert gas (argon or nitrogen) into the mixture through a gas dispersion frit while agitating and heating the mixture to 120° C. for 1 hour. The final reaction product is cooled slightly, and poured into a glass container purged with nitrogen for storage.

Quaternization of bis(hexamethylene)triamine which is ethoxylated to an average of 20 ethoxylations per backbone NH unit Into a weighed, 500 ml, 3 neck round bottom flask fitted with argon inlet, condenser, addition funnel, thermometer, mechanical stirring and argon outlet (connected to a bubbler) is added BHMT EO20 (150 g, 0.032 mol, 0.096 mol N, 98% active, m.w.–4615) and methylene chloride (300 g) under argon. The mixture is stirred at room temperature until the polymer has dissolved. The mixture is then cooled to 5° C. using an ice bath. Dimethyl sulfate (12.8 g, 0.1 mol, 99%, m.w.–126.13) is slowly added using an addition funnel over a period of 5 minutes. The ice bath is removed and the reaction is allowed to rise to room temperature. After 48 hrs. the reaction is complete.

Sulfation of bis(hexamethylene)triamine which is quaternized to about 90% of the backbone nitrogens of the product admixture and which is ethoxylated to an average of 20 ethoxylations per backbone NH unit Under argon, the reaction mixture from the quaternization step is cooled to 5° C. using an ice bath (BHMT EO20, 90+mol % quat, 0.16 mol OH). Chlorosulfonic acid (7.53 g, 0.064 mol, 99%, mw–116.52) is slowly added using an addition funnel. The temperature of the reaction mixture is not allowed to rise above 10° C. The ice bath is removed and the reaction is allowed to rise to room temperature. After 6 hrs. the reaction is complete. The reaction is again cooled to 5° C. and sodium methoxide (28.1 g, 0.13 mol, Aldrich, 25% in methanol, m.w.–54.02) is slowly added to the rapidly stirred mixture. The temperature of the reaction mixture is not allowed to rise above 10° C. The reaction mixture is transferred to a single neck round bottom flask. Purified water (500 ml) is added to the reaction mixture and the methylene chloride, methanol and some water is stripped off on a rotary evaporator at 50° C. The clear, light yellow solution is transferred to a bottle for storage. The final product pH is checked and adjusted to ~9 using 1N NaOH or 1N HCl as needed. Final weight, 530 g.

Xyloglucanase Enzyme

The compositions of the present invention may also comprise a xyloglucanase enzyme. Suitable xyloglucanases for the purpose of the present invention are enzymes exhibiting endoglucanase activity specific for xyloglucan. The xyloglucanase is incorporated into the compositions of the invention preferably at a level of from about 0.00005% (0.5 ppm), preferably form about 0.0001% (1 ppm) to about 0.005% (50 ppm), preferably to about 0.001% (10 ppm) by weight, of pure enzyme.

As used herein, the term "endoglucanase activity" means the capability of the enzyme to hydrolyze 1,4-β-D-glycosidic linkages present in any cellulosic material, such as cellulose, cellulose derivatives, lichenin, β-D-glucan, or xyloglucan. The endoglucanase activity may be determined in accordance with methods known in the art, examples of which are described in WO 94/14953 and hereinafter. One unit of endoglucanase activity (e.g. CMCU, AVIU, XGU or BGU) is defined as the production of 1 $\mu$mol reducing sugar/min from a glucan substrate, the glucan substrate being, e.g., CMC (CMCU), acid swollen Avicell (AVIU), xyloglucan (XGU) or cereal β-glucan (BGU). The reducing sugars are determined as described in WO 94/14953 and hereinafter. The specific activity of an endoglucanase towards a substrate is defined as units/mg of protein.

More specifically, as used herein the term "specific for xyloglucan" means that the endoglucanase enzyme exhibits its highest endoglucanase activity on a xyloglucan substrate, and preferably less than 75% activity, more preferably less than 50% activity, most preferably less than about 25% activity, on other cellulose-containing substrates such as carboxymethyl cellulose, cellulose, or other glucans.

Preferably, the specificity of an endoglucanase towards xyloglucan is further defined as a relative activity determined as the release of reducing sugars at optimal conditions obtained by incubation of the enzyme with xyloglucan and the other substrate to be tested, respectively. For instance, the specificity may be defined as the xyloglucan to β-glucan activity (XGU/BGU), xyloglucan to carboxy methyl cellulose activity (XGU/CMCU), or xyloglucan to acid swollen Avicell activity (XGU/AVIU), which is preferably greater than about 50, such as 75, 90 or 100.

The term "derived from" as used herein refers not only to an endoglucanase produced by strain CBS 101.43, but also an endoglucanase encoded by a DNA sequence isolated from strain CBS 101.43 and produced in a host organism transformed with said DNA sequence. The term "homologue" as used herein indicates a polypeptide encoded by DNA which hybridizes to the same probe as the DNA coding for an endoglucanase enzyme specific for xyloglucan under certain specified conditions (such as presoaking in 5×SSC and pre-hybridizing for 1 h at −40° C. in a solution of 5×SSC, 5×Denhardt's solution, and 50 μg of denatured sonicated calf thymus DNA, followed by hybridization in the same solution supplemented with 50 μCi 32-P-dCTP labeled probe for 18 h at −40° C. and washing three times in 2×SSC, 0.2% SDS at 40° C. for 30 minutes). More specifically, the term is intended to refer to a DNA sequence which is at least 70% homologous to any of the sequences shown above encoding an endoglucanase specific for xyloglucan, including at least 75%, at least 80%, at least 85%, at least 90% or even at least 95% with any of the sequences shown above. The term is intended to include modifications of any of the DNA sequences shown above, such as nucleotide substitutions which do not give rise to another amino acid sequence of the polypeptide encoded by the sequence, but which correspond to the codon usage of the host organism into which a DNA construct comprising any of the DNA sequences is introduced or nucleotide substitutions which do give rise to a different amino acid sequence and therefore, possibly, a different amino acid sequence and therefore, possibly, a different protein structure which might give rise to an endoglucanase mutant with different properties than the native enzyme. Other examples of possible modifications are insertion of one or more nucleotides into the sequence, addition of one or more nucleotides at either end of the sequence, or deletion of one or more nucleotides at either end or within the sequence.

Endoglucanase specific for xyloglucan useful in the present invention preferably is one which has a XGU/BGU, XGU/CMU and/or XGU/AVIU ratio (as defined above) of more than 50, such as 75, 90 or 100.

Furthermore, the endoglucanase specific for xyloglucan is preferably substantially devoid of activity towards β-glucan and/or exhibits at the most 25% such as at the most 10% or about 5%, activity towards carboxymethyl cellulose and/or Avicell when the activity towards xyloglucan is 100%. In addition, endoglucanase specific for xyloglucan of the invention is preferably substantially devoid of transferase activity, an activity which has been observed for most endoglucanases specific for xyloglucan of plant origin.

Endoglucanase specific for xyloglucan may be obtained from the fungal species *A. aculeatus,* as described in WO 94/14953. Microbial endoglucanases specific for xyloglucan has also been described in WO 94/14953. Endoglucanases specific for xyloglucan from plants have been described, but these enzymes have transferase activity and therefore must be considered inferior to microbial endoglucanases specific for xyloglucan whenever extensive degradation of xyloglucan is desirable. An additional advantage of a microbial enzyme is that it, in general, may be produced in higher amounts in a microbial host, than enzymes of other origins.

Surfactant System

The laundry detergent compositions of the present invention comprise a surfactant system. The surfactant systems of the present invention may comprise any type of detersive surfactant, non-limiting examples of which include one or more mid-chain branched alkyl sulfate surfactants, one or more mid-chain branched alkyl alkoxy sulfate surfactants, one or more mid-chain branched aryl sulfonate surfactants, one or more non mid-chain branched sulphonates, sulphates, cationic surfactants, zwitterionic surfactants, ampholytic surfactants, and mixtures thereof.

The total amount of surfactant present in the compositions of the present invention is from about 0.01% by weight, preferably from about 0.1% more preferably from about 1% to about 60%, preferably to about 30% by weight, of said composition.

Nonlimiting examples of surfactants useful herein include:

a) $C_{11}$–$C_{18}$ alkyl benzene sulfonates (LAS);

b) $C_6$–$C_{18}$ mid-chain branched aryl sulfonates (BLAS);

c) $C_{10}$–$C_{20}$ primary, α or ω-branched, and random alkyl sulfates (AS);

d) $C_{14}$–$C_{20}$ mid-chain branched alkyl sulfates (BAS);

e) $C_{10}$–$C_{18}$ secondary (2,3) alkyl sulfates as described in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

f) $C_{10}$–$C_{18}$ alkyl alkoxy sulfates ($AE_xS$) wherein preferably x is from 1–7;

g) $C_{14}$–$C_{20}$ mid-chain branched alkyl alkoxy sulfates ($BAE_xS$);

h) $C_{10}$–$C_{18}$ alkyl alkoxy carboxylates preferably comprising 1–5 ethoxy units;

i) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

j) $C_{14}$–$C_{22}$ mid-chain branched alkyl alkoxylates, $BAE_x$;

k) Alkylpolysaccharides as disclosed in U.S. Pat. No. 4,565,647 Llenado, issued Jan. 26, 1986, incorporated herein by reference;

l) Polyhydroxy fatty acid amides having the formula:

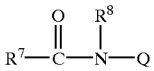

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_nCH_2OH$, $—CH_2(CH_2OH)(CHOH)_{n-1}CH_2OH$, $—CH_2(CHOH)_2—(CHOR')(CHOH)CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

A non-limiting example of a nonionic surfactant suitable for use in the present invention has the formula:

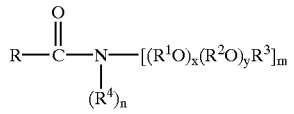

wherein

R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof.

$R^1$ is ethylene; $R^2$ is $C_3$–$C_4$ linear alkyl, $C_3$–$C_4$ branched alkyl, and mixtures thereof; preferably $R^2$ is 1,2-propylene.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent and is instead replaced by a —$[(R^1O)_x(R^2O)_yR^3]$ unit.

The index m is 1 or 2, the index n is 0 or 1, provided that when m is equal to 1, n is equal to 1; and when m is 2 n is 0; preferably m is equal to 1 and n is equal to one, resulting in one —$[(R^1O)_x(R^2O)_yR^3]$ unit and $R^4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all of the alkyleneoxy units are ethyleneoxy units. Those skilled in the art of ethoxylated polyoxyalkylene alkyl amide surface active agents will recognized that the values for the indices x and y are average values and the true values may range over several values depending upon the process used to alkoxylate the amides.

The mid-chain branched alkyl sulfate surfactants of the present invention have the formula:

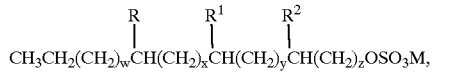

the alkyl alkoxy sulfates have the formula:

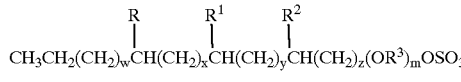

the alkyl alkoxylates have the formula:

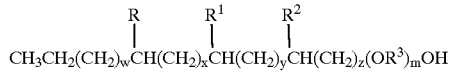

wherein R, $R^1$, and $R^2$ are each independently hydrogen, $C_1$–$C_3$ alkyl, and mixtures thereof; provided at least one of R, $R^1$, and $R^2$ is not hydrogen; preferably R, $R^1$, and $R^2$ are methyl; preferably one of R, $R^1$, and $R^2$ is methyl and the other units are hydrogen. The total number of carbon atoms in the mid-chain branched alkyl sulfate and alkyl alkoxy sulfate surfactants is from 14 to 20; the index w is an integer from 0 to 13; y is an integer from 0 to 13; y is an integer from 0 to 13; z is an integer of at least 1; provided w+x+y+z is from 8 to 14 and the total number of carbon atoms in a surfactant is from 14 to 20; $R^3$ is $C_1$–$C_4$ linear or branched alkylene, preferably ethylene, 1,2-propylene, 1,3-propylene, 1,2-butylene, 1,4-butylene, and mixtures thereof. However, a preferred embodiment of the present invention comprises from 1 to 3 units wherein $R^3$ is 1,2-propylene, 1,3-propylene, or mixtures thereof followed by the balance of the $R^3$ units comprising ethylene units. Another preferred embodiment comprises $R^3$ units which are randomly ethylene and 1,2-propylene units. The average value of the index m is at least about 0.01. When the index m has low values, the surfactant system comprises mostly alkyl sulfates with a small amount of alkyl alkoxy sulfate surfactant. Some tertiary carbon atoms may be present in the alkyl chain, however, this embodiment is not desired.

M denotes a cation, preferably hydrogen, a water soluble cation, and mixtures thereof. Non-limiting examples of water soluble cations include sodium, potassium, lithium, ammonium, alkyl ammonium, and mixtures thereof.

Formulations

As described herein above the compositions of the present invention may be in any liquid form inter alia pourable liquid, paste. Depending upon the specific form of the laundry composition, as well as, the expected use thereof, the formulator may will use different zwitterionic polyamine/ethoxylated polyalkyleneimine combinations.

Preferably the Heavy Duty Liquid (HDL) compositions according to the present invention comprise:

a) from about 0.01%, preferably from about 0.1%, more preferably from about 0.5%, most preferably form about 1% to about 10%, preferably to about 5%, more preferably to about 3%, most preferably to about 2% by weight, of a zwitterionic polyamine wherein said polyamine comprises more anionic substituents than the number of backbone quaternary nitrogen units;

b) from about 0.00005%, preferably form about 0.0001% to about 0.005%, preferably to about 0.001% by weight, of a xyloglucanase enzyme;

c) from about 0.5% to about 50% by weight, of a surfactant system comprising:

i) from about 10% to about 99% by weight, of said surfactant system, of a nonionic surfactant;

ii) from about 1% to about 90% by weight, of said surfactant system, of an anionic surfactant;

iii) optionally, from 1% to about 50% by weight, of said surfactant system, of a detersive surfactant selected from the group consisting of cationic surfactants, zwitterionic surfactants, ampholytic surfactants, and mixtures thereof; and d) the balance carriers and adjunct ingredients.

HDL laundry detergent compositions will typically comprise more of anionic detersive surfactants in addition to the preferred use of nonionic surfactants to augment the mid-chain branched surfactants. Therefore, the formulator will generally employ a zwitterionic polyamine having a greater number of cationic charged backbone quaternary units than the number of $R^1$ unit anionic moieties. This net charge balance, taken together with the preferably greater degree of hydrophobicity of backbone R units, inter alia, hexamethylene units, boosts the interaction of the surfactant molecules with the hydrophilic soil active zwitterionic polymers and thereby provides increased effectiveness. The lower net anionic charge of HDL's is surprisingly compatible with the relatively hydrophobic backbones of the more preferred zwitterionic polymers described herein. However, depending upon the composition of the surfactant system, the formulator may desire to either boost or reduce the hydrophilic character of the R units by the use of, inter alia, alkyleneoxy units in combination with alkylene units.

Preferably the Heavy Duty Liquid (HDL) compositions according to the present invention comprise:

a) from about 0.01%, preferably from about 0.1%, more preferably from about 0.5%, most preferably form about 1% to about 10%, preferably to about 5%, more preferably to about 3%, most preferably to about 2% by weight, of a zwitterionic polyamine wherein said polyamine comprises more anionic substituents than the number of backbone quaternary nitrogen units;

b) from about 0.00005% to about 0.005% by weight, of an enzyme system comprising;
   i) from about 20% to about 99% by weight, of a said enzyme system, a xyloglucanase enzyme;
   ii) from about 1% to about 80% by weight, of said enzyme system, a mannanase enzyme;
   iii) optionally, from 1% to 80% by weight, of said enzyme system one or more enzymes selected from the group consisting of protease enzymes, amylase enzymes, cellulase enzymes, lipolase enzymes, lipase enzymes, peroxidase enzymes, cutinase enzymes, and mixtures thereof;

c) from about 0.5% to about 50% by weight, of a surfactant system comprising:
   i) from about 10% to about 99% by weight, of said surfactant system, of a nonionic surfactant;
   ii) from about 1% to about 90% by weight, of said surfactant system, of an anionic surfactant;
   iii) optionally, from 1% to about 50% by weight, of said surfactant system, of a detersive surfactant selected from the group consisting of cationic surfactants, zwitterionic surfactants, ampholytic surfactants, and mixtures thereof; and d) the balance carriers and adjunct ingredients.

Adjunct Ingredients

The following are non-limiting examples of adjunct ingredients useful in the liquid laundry compositions of the present invention, said adjunct ingredients include additional enzymes, enzyme stabilizers, builders, optical brighteners, soil release polymers, dye transfer agents, dispersents, suds suppressers, dyes, perfumes, colorants, filler salts, hydrotropes, photoactivators, fluorescers, fabric conditioners, hydrolyzable surfactants, preservatives, antioxidants, chelants, stabilizers, anti-shrinkage agents, anti-wrinkle agents, germicides, fungicides, anti corrosion agents, and mixtures thereof.

Enzymes

Enzymes are a preferred adjunct ingredient of the present invention and comprise the enzyme systems of the present invention. The selection of enzymes is left to the formulator, however, the examples herein below illustrate the use of enzymes in the liquid laundry detergents of the present invention. The enzyme systems of the present invention comprise:

i) from about 20% to about 99% by weight, of a said enzyme system, a xyloglucanase enzyme; and ii) optionally, from 1% to 80% by weight, of said enzyme system one or more enzymes selected from the group consisting of mannanase enzymes, protease enzymes, amylase enzymes, cellulase enzymes, lipolase enzymes, lipase enzymes, peroxidase enzymes, cutinase enzymes, and mixtures thereof.

A preferred enzyme system according to the present invention comprises:

i) from about 20% to about 99% by weight, of a said enzyme system, a xyloglucanase enzyme;

ii) from about 1% to about 80% by weight, of said enzyme system, a mannanase enzyme;

iii) optionally, from 1% to 80% by weight, of said enzyme system one or more enzymes selected from the group consisting of protease enzymes, amylase enzymes, cellulase enzymes, lipolase enzymes, lipase enzymes, peroxidase enzymes, cutinase enzymes, and mixtures thereof.

A more preferred enzyme system according to the present invention comprises:

i) from about 40% to about 60% by weight, of a said enzyme system, a xyloglucanase enzyme; and ii) from about 40% to about 60% by weight, of said enzyme system, a mannanase enzyme.

"Detersive enzyme", as used herein, means any enzyme having a cleaning, stain removing or otherwise beneficial effect in a liquid laundry, hard surface cleaning or personal care detergent composition. Preferred detersive enzymes are hydrolases such as proteases, amylases and lipases. Preferred enzymes for liquid laundry purposes include, but are not limited to, inter alia proteases, cellulases, lipases and peroxidases.

Protease Enzymes

The preferred liquid laundry detergent compositions according to the present invention further comprise at least 0.001% by weight, of a protease enzyme. However, an effective amount of protease enzyme is sufficient for use in the liquid laundry detergent compositions described herein. The term "an effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. The protease enzymes of the present invention are usually present in such commercial preparations at levels sufficient to provide from 0.005 to 0.1 Anson units (AU) of activity per gram of composition.

Preferred liquid laundry detergent compositions of the present invention comprise modified protease enzymes derived from *Bacillus amyloliquefaciens* or *Bacillus lentus*. For the purposes of the present invention, protease enzymes derived from *B. amyloliquefaciens* are further referred to as "subtilisin BPN" also referred to as "Protease A" and protease enzymes derived from *B. Lentus* are further referred to as "subtilisin 309". For the purposes of the present invention, the numbering of *Bacillus amyloliquefaciens* subtilisin, as described in the patent applications of A. Baeck, et al, entitled "Protease-Containing Cleaning Compositions" having U.S. Ser. No. 08/322,676, serves as the amino acid sequence numbering system for both subtilism BPN' and subtilisin 309.

Derivatives of *Bacillus amyloliquefaciens* Subtilisin -BPN' Enzymes

A preferred protease enzyme for use in the present invention is a variant of Protease A (BPN') which is a non-naturally occurring carbonyl hydrolase variant having a different proteolytic activity, stability, substrate specificity, pH profile and/or performance characteristic as compared to the precursor carbonyl hydrolase from which the amino acid sequence of the variant is derived. This variant of BPN' is disclosed in EP 130,756 A, Jan. 9, 1985. Specifically Protease A-BSV is BPN' wherein the Gly at position 166 is replaced with Asn, Ser, Lys, Arg, His, Gln, Ala, or Glu; the Gly at position 169 is replaced with Ser; the Met at position 222 is replaced with Gln, Phe, Cys, His, Asn, Glu, Ala or Thr; or alternatively the Gly at position 166 is replaced with Lys, and the Met at position 222 is replaced with Cys; or alternatively the Gly at position 169 is replaced with Ala and the Met at position 222 is replaced with Ala.

Protease B

A preferred protease enzyme for use in the present invention is Protease B. Protease B is a non-naturally occurring carbonyl hydrolase variant having a different proteolytic activity, stability, substrate specificity, pH profile and/or performance characteristic as compared to the precursor carbonyl hydrolase from which the amino acid sequence of the variant is derived. Protease B is a variant of BPN' in which tyrosine is replaced with leucine at position +217 and as further disclosed in EP 303,761 A, Apr. 28, 1987 and EP 130,756 A, Jan. 9, 1985.

Bleach Stable Variants of Protease B (Protease B-BSV)

A preferred protease enzyme for use in the present invention are bleach stable variants of Protease B. Specifically Protease B-BSV are variants wherein the Gly at position 166 is replaced with Asn, Ser, Lys, Arg, His, Gln, Ala, or Glu; the Gly at position 169 is replaced with Ser; the Met at position 222 is replaced with Gln, Phe, Cys, His, Asn, Glu, Ala or Thr; or alternatively the Gly at position 166 is replaced with Lys, and the Met at position 222 is replaced with Cys; or alternatively the Gly at position 169 is replaced with Ala and the Met at position 222 is replaced with Ala.

Surface Active Variants of Protease B

Preferred Surface Active Variants of Protease B comprise BPN' wild-type amino acid sequence in which tyrosine is replaced with leucine at position +217, wherein the wild-type amino acid sequence at one or more of positions 199, 200, 201, 202, 203, 204, 205, 206, 207, 208, 209, 210, 211, 212, 213, 214, 215, 216, 218, 219 or 220 is substituted; wherein the BPN' variant has decreased adsorption to, and increased hydrolysis of, an insoluble substrate as compared to the wild-type subtilisin BPN'. Preferably, the positions having a substituted amino acid are 199, 200, 201, 202, 205, 207, 208, 209, 210, 211, 212, or 215; more preferably, 200, 201, 202, 205 or 207.

Also preferred proteases derived from *Bacillus amyloliquefaciens* subtilisin are subtilisin BPN' enzymes that have been modified by mutating the various nucleotide sequences that code for the enzyme, thereby modifying the amino acid sequence of the enzyme. These modified subtilisin enzymes have decreased adsorption to and increased hydrolysis of an insoluble substrate as compared to the wild-type subtilisin. Also suitable are mutant genes encoding for such BPN' variants.

Derivatives of Subtilisin 309

Further preferred protease enzymes for use according to the present invention also include the "subtilisin 309" variants. These protease enzymes include several classes of subtilisin 309 variants described herein below.

Protease C

A preferred protease enzyme for use in the compositions of the present invention Protease C. Protease C is a variant of an alkaline serine protease from Bacillus in which lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

Protease D

A preferred protease enzyme for use in the present invention is Protease D. Protease D is a carbonyl hydrolase variant derived from *Bacillus lentus* subtilisin having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

A. Loop Region 6 Substitution Variants—These subtilisin 309-type variants have a modified amino acid sequence of subtilisin 309 wild-type amino acid sequence, wherein the modified amino acid sequence comprises a substitution at one or more of positions 193, 194, 195, 196, 197, 199, 200, 201, 202, 203, 204, 205, 206, 207, 208, 209, 210, 211, 212, 213 or 214; whereby the subtilisin 309 variant has decreased adsorption to, and increased hydrolysis of, an insoluble substrate as compared to the wild-type subtilisin 309. Preferably these proteases have amino acids substituted at 193, 194, 195, 196, 199, 201, 202, 203, 204, 205, 206 or 209; more preferably 194, 195, 196, 199 or 200.

B. Multi-Loop Regions Substitution Variants—These subtilisin 309 variants may also be a modified amino acid sequence of subtilisin 309 wild-type amino acid sequence, wherein the modified amino acid sequence comprises a substitution at one or more positions in one or more of the first, second, third, fourth, or fifth loop regions; whereby the subtilisin 309 variant has decreased adsorption to, and increased hydrolysis of, an insoluble substrate as compared to the wild-type subtilisin 309.

C. Substitutions at positions other than the loop regions—In addition, one or more substitution of wild-type subtilisin 309 may be made at positions other than positions in the loop regions, for example, at position 74. If the additional substitution to the subtilisin 309 is mad at position 74 alone, the substitution is preferably with Asn, Asp, Glu, Gly, His, Lys, Phe or Pro, preferably His or Asp. However modifications can be made to one or more loop positions as well as position 74, for example residues 97, 99, 101, 102, 105 and 121.

Subtilisin BPN' variants and subtilisin 309 variants are further described in WO 95/29979, WO 95/30010 and WO 95/30011, all of which were published Nov. 9, 1995, all of which are incorporated herein by reference.

A further preferred protease enzyme for use in combination with the modified polyamines of the present invention is ALCALASE® from Novo. Another suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include SAVINASE® from Novo and MAXATASE® from International Bio-Synthetics, Inc., The Netherlands. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo.

An alternative protease, "Protease E", is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a subtitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin; and one or more cleaning adjunct materials.

While any combination of the above listed amino acid substitutions may be employed, the preferred protease variant enzymes useful for the present invention comprise the substitution, deletion or insertion of amino acid residues in the following combinations:

(1) a protease variant including substitutions of the amino acid residues at position 103 and at one or more of the following positions 236 and 245;

(2) a protease variant including substitutions of the amino acid residues at positions 103 and 236 and at one or more of the following positions: 12, 61, 62, 68, 76, 97, 98, 101, 102, 104, 109, 130, 131, 159, 183, 185, 205, 209, 210, 211, 212, 213, 215, 217, 230, 232, 248, 252, 257, 260, 270 and 275;

(3) a protease variant including substitutions of the amino acid residues at positions 103 and 245 and at one or more of the following positions: 12, 61, 62, 68, 76, 97, 98, 101, 102, 104, 109, 130, 131, 159, 170, 183, 185, 205, 209, 210, 211, 212, 213, 215, 217, 222, 230, 232, 248, 252, 257, 260, 261, 270 and 275; and (4) a protease variant including substitutions of the amino acid residues at positions 103, 236 and 245 and at one or more of the following positions: 12, 61, 62, 68, 76, 97, 98, 101, 102, 104, 109, 130, 131, 159, 183, 185, 205, 209, 210, 211, 212, 213, 215, 217, 230, 232, 243, 248, 252, 257, 260, 270 and 275 , as described in the patent applications of C. Ghosh, et al, entitled "Cleaning Compositions Containing Multiply-Substituted Protease Variants" having U.S. Ser. No. 09/529,905, filed Oct. 23, 1998.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Commercially available proteases useful in the present invention are known as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

In addition to the above-described protease enzymes, other enzymes suitable for use in the liquid laundry detergent compositions of the present invention are further described herein below.

Other Enzymes

Enzymes in addition to the protease enzyme can be included in the present detergent compositions for a variety of purposes, including removal of protein-based, carbohydrate-based, or triglyceride-based stains from surfaces such as textiles, for the prevention of refugee dye transfer, for example in laundering, and for fabric restoration. Suitable enzymes include amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from about 0.001%, preferably from about 0.01% to about 5%, preferably to about 1% by weight of a commercial enzyme preparation. Protease enzymes are usually present in such commercial preparations at levels sufficient to provide from 0.005 to 0.1 Anson units (AU) of activity per gram of composition. For certain detergents, it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp 6518–6521. Certain preferred embodiments of the present compositions can make use of amylases having improved stability in detergents, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Baccillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B.licheniformis* alpha-amylase, known as TERMAMYL®, or the homologous position variation of a similar parent amylase, such as *B. amyloliquefaciens, B. subtilis,* or *B. stearothermophilus;* (b) stability-enhanced amylases as described by Genencor International in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *B.licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® (Novo) is especially useful. See also WO 9117243 to Novo.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum,* e.g. *Chromobacter viscosum var. lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substances during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139 McCarty et al., issued Jan. 5, 1971. Enzymes are further disclosed in U.S. Pat. No. 4,101,457 Place et al, issued Jul. 18, 1978, and U.S. Pat. No. 4,507,219 Hughes, issued Mar. 26, 1985. Enzyme materials useful for liquid detergent formulations, and their incorporation into such formulations, are disclosed in U.S. Pat. No. 4,261,868 Hora et al., issued Apr. 14, 1981. Enzymes for use in detergents can be stabilized by various techniques. Enzyme stabilization techniques are disclosed and exemplified in U.S. Pat. No. 3,600,319 Gedge et al., issued Aug. 17, 1971; EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

A further preferred enzyme according to the present invention are mannanase enzymes. When present mannanase enzymes comprise from about 0.0001%, preferably from 0.0005%, more preferably from about 0.001% to about 2%, preferably to about 0.1% more preferably to about 0.02% by weight, of said composition.

Preferably, the following three mannans-degrading enzymes: EC 3.2.1.25: β-mannosidase, EC 3.2.1.78: Endo-1,4-β-mannosidase, referred therein after as "mannanase" and EC 3.2.1.100: 1,4-β-mannobiosidase (IUPAC Classification-Enzyme nomenclature, 1992 ISBN 0-12-227165-3 Academic Press) are useful in the compositions of the present invention.

More preferably, the detergent compositions of the present invention comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

In particular, Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactogluco-mannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The degradation of galactomannans and galactoglucomannans is facilitated by full or partial removal of the galactose sidebranches. Further the degradation of the acetylated mannans, glucomannans, galactomannans and galactogluco-mannans is facilitated by full or partial deacetylation. Acetyl groups can be removed by alkali or by mannan acetylesterases. The oligomers which are released from the mannanases or by a combination of mannanases and α-galactosidase and/or mannan acetyl esterases can be further degraded to release free maltose by β-mannosidase and/or β-glucosidase.

Mannanases have been identified in several Bacillus organisms. For example, Talbot et al., *Appl. Environ. Microbiol.,* Vol.56, No. 11, pp. 3505–3510 (1990) describes a beta-mannanase derived from *Bacillus stearothermophilus* in dimer form having molecular weight of 162 kDa and an optimum pH of 5.5–7.5. Mendoza et al., World J. Microbiol. Biotech., Vol. 10, No. 5, pp. 551–555 (1994) describes a beta-mannanase derived from *Bacillus subtilis* having a molecular weight of 38 kDa, an optimum activity at pH 5.0 and 55C and a pI of 4.8. JP-03047076 discloses a beta-mannanase derived from Bacillus sp., having a molecular weight of 373 kDa measured by gel filtration, an optimum pH of 8–10 and a pI of 5.3–5.4. JP-63056289 describes the production of an alkaline, thermostable beta-mannanase which hydrolyses beta-1,4-D-mannopyranoside bonds of e.g. mannans and produces manno-oligosaccharides. JP-63036774 relates to the Bacillus microorganism FERM P-8856 which produces beta-mannanase and beta-mannosidase at an alkaline pH. JP-08051975 discloses alkaline beta-mannanases from alkalophilic Bacillus sp. AM-001. A purified mannanase from *Bacillus amyloliquefaciens* useful in the bleaching of pulp and paper and a method of preparation thereof is disclosed in WO 97/11164. WO 91/18974 describes a hemicellulase such as a glucanase, xylanase or mannanase active at an extreme pH and temperature. WO 94/25576 discloses an enzyme from *Aspergillus aculeatus,* CBS 101.43, exhibiting mannanase activity which may be useful for degradation or modification of plant or algae cell wall material. WO 93/24622 discloses a mannanase isolated from *Trichoderma reseei* useful for bleaching lignocellulosic pulps . An hemicellulase capable of degrading mannan-containing hemicellulose is described in WO91/18974 and a purified mannanase from *Bacillus amyloliquefaciens* is described in WO97/11164.

Preferably, the mannanase enzyme will be an alkaline mannanase as defined below, more preferably, a mannanase originating from a bacterial source. Especially, the laundry detergent composition of the present invention will comprise an alkaline mannanase selected from the mannanase from the strain *Bacillus agaradherens* NICMB 40482; the mannanase from Bacillus strain 168, gene yght; the mannanase from Bacillus sp. I633 and/or the mannanase from Bacillus sp. AAI12. Most preferred mannanase for the inclusion in the detergent compositions of the present invention is the mannanase enzyme originating from Bacillus sp. I633 as described in the co-pending application No. PA 1998 01340.

The terms "alkaline mannanase enzyme" is meant to encompass an enzyme having an enzymatic activity of at least 10%, preferably at least 25%, more preferably at least 40% of its maximum activity at a given pH ranging from 7 to 12, preferably 7.5 to 10.5.

The alkaline mannanase from *Bacillus agaradherens* NICMB 40482 is described in the co-pending U.S. patent application Ser. No. 09/111,256. More specifically, this mannanase is:

i) a polypeptide produced by *Bacillus agaradherens,* NCIMB 40482; or ii) a polypeptide comprising an amino acid sequence as shown in positions 32–343 of SEQ ID NO:2 as shown in U.S. patent application Ser. No. 09/111,256; or iii) an analogue of the polypeptide defined in i) or ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed is the corresponding isolated polypeptide having mannanase activity selected from the group consisting of:

a) polynucleotide molecules encoding a polypeptide having mannanase activity and comprising a sequence of nucleotides as shown in SEQ ID NO: 1 from nucleotide 97 to nucleotide 1029 as shown in U.S. patent application Ser. No. 09/111,256;

b) species homologs of (a);

c) polynucleotide molecules that encode a polypeptide having mannanase activity that is at least 70% identical to the amino acid sequence of SEQ ID NO: 2 from amino acid residue 32 to amino acid residue 343 as shown in U.S. patent application Ser. No. 09/111,256;

d) molecules complementary to (a), (b) or (c); and e) degenerate nucleotide sequences of (a), (b), (c) or (d).

The plasmid pSJ1678 comprising the polynucleotide molecule (the DNA sequence) encoding said mannanase has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 18, 1998 under the deposition number DSM 12180.

A second more preferred enzyme is the mannanase from the *Bacillus subtilis* strain 168, which is described in the co-pending U.S. patent application Ser. No. 09/095,163. More specifically, this mannanase is:

i) is encoded by the coding part of the DNA sequence shown in SED ID No. 5 shown in the U.S. patent application Ser. No. 09/095,163 or an analogue of said sequence; and/or ii) a polypeptide comprising an amino acid sequence as shown SEQ ID NO:6 shown in the U.S. patent application Ser. No. 09/095,163; or iii) an analogue of the polypeptide defined in ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed in the corresponding isolated polypeptide having mannanase activity selected from the group consisting of:

a) polynucleotide molecules encoding a polypeptide having mannanase activity and comprising a sequence of nucleotides as shown in SEQ ID NO:5 as shown in the U.S. patent application Ser. No. 09/095,163 b) species homologs of (a);

c) polynucleotide molecules that encode a polypeptide having mannanase activity that is at least 70% identical to the amino acid sequence of SEQ ID NO: 6 as shown in the U.S. patent application Ser. No. 09/095,163;

d) molecules complementary to (a), (b) or (c); and e) degenerate nucleotide sequences of (a), (b), (c) or (d).

A third more preferred mannanase is described in the co-pending Danish patent application No. PA 1998 01340. More specifically, this mannanase is:

i) a polypeptide produced by Bacillus sp. 1633;

ii) a polypeptide comprising an amino acid sequence as shown in positions 33–340 of SEQ ID NO:2 as shown in the Danish application No. PA 1998 01340; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

a) polynucleotide molecules encoding a polypeptide having mannanase activity and comprising a sequence of nucleotides as shown in SEQ ID NO: 1 from nucleotide 317 to nucleotide 1243 the Danish application No. PA 1998 01340;

b) species homologs of (a);

c) polynucleotide molecules that encode a polypeptide having mannanase activity that is at least 65% identical to the amino acid sequence of SEQ ID NO: 2 from amino acid residue 33 to amino acid residue 340 the Danish application No. PA 1998 01340;

d) molecules complementary to (a), (b) or (c); and e) degenerate nucleotide sequences of (a), (b), (c) or (d).

The plasmid pBXM3 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 29, 1998 under the deposition number DSM 12197.

A fourth more preferred mannanase is described in the Danish co-pending patent application No. PA 1998 01341. More specifically, this mannanase is:

i) a polypeptide produced by Bacillus sp. AAI 12;

ii) a polypeptide comprising an amino acid sequence as shown in positions 25–362 of SEQ ID NO:2 as shown in the Danish application No. PA 1998 01341; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of a) polynucleotide molecules encoding a polypeptide having mannanase activity and comprising a sequence of nucleotides as shown in SEQ ID NO: 1 from nucleotide 225 to nucleotide 1236 as shown in the Danish application No. PA 1998 01341;

b) species homologs of (a);

c) polynucleotide molecules that encode a polypeptide having mannanase activity that is at least 65% identical to the amino acid sequence of SEQ ID NO: 2 from amino acid residue 25 to amino acid residue 362 as shown in the Danish application No. PA 1998 01341;

d) molecules complementary to (a), (b) or (c); and e) degenerate nucleotide sequences of (a), (b), (c) or (d).

The plasmid pBXM1 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on Oct. 7, 1998 under the deposition number DSM 12433.

Enzyme Stabilizing System

Enzyme-containing, including but not limited to, liquid compositions, herein may comprise from about 0.001%, preferably from about 0.005%, more preferably from about 0.01% to about 10%, preferably to about 8%, more preferably to about 6% by weight, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful, for example for promoting the grease-cutting action of certain types of surfactant.

Another stabilizing approach is by use of borate species disclosed in U.S. Pat. No. 4,537,706 Severson, issued Aug. 27, 1985. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions may further comprise from 0, preferably from about 0.01% to about 10%, preferably to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during fabric-washing, can be relatively large; accordingly, enzyme stability to chlorine in-use is sometimes problematic. Since perborate or percarbonate, which have the ability to react with chlorine bleach, may present in certain of the instant compositions in amounts accounted for separately from the stabilizing system, the use of additional stabilizers against chlorine, may, most generally, not be essential, though improved results may be obtainable from their use. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetraacetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by ingredients separately listed under better recognized functions, (e.g., hydrogen peroxide sources), there is no absolute requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients, if used. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392 Baginski et al., issued Mar. 24, 1987.

Builders

The laundry detergent compositions of the present invention preferably comprise one or more detergent builders or builder systems. When present, the compositions will typically comprise from about 1% builder, preferably from about 5%, more preferably from about 10% to about 80%, preferably to about 50%, more preferably to about 30% by weight, of detergent builder.

The level of builder can vary widely depending upon the end use of the composition and its desired physical form, for example, preferred compositions will typically comprise from about 1% builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839 Rieck, issued May 12, 1987. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein.

Examples of carbonate builders are the alkaline earth and alkali metal carbonates as disclosed in German Patent Application No. 2,321,001 published on Nov. 15, 1973.

Organic detergent builders suitable for the purposes of the present invention include, but are not restricted to, a wide variety of polycarboxylate compounds. As used herein, "polycarboxylates" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability..

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Dispersants

A description of other suitable polyalkyleneimine dispersants which may be optionally combined with the bleach stable dispersants of the present invention can be found in U.S. Pat. No. 4,597,898 Vander Meer, issued Jul. 1, 1986; European Patent Application 111,965 Oh and Gosselink, published Jun. 27, 1984; European Patent Application 111,984 Gosselink, published Jun. 27, 1984; European Patent Application 112,592 Gosselink, published Jul. 4, 1984; U.S. Pat. No. 4,548,744 Connor, issued Oct. 22, 1985; and U.S. Pat. No. 5,565,145 Watson et al., issued Oct. 15, 1996; all of which are included herein by reference. However, any suitable clay/soil dispersant or anti-redepostion agent can be used in the laundry compositions of the present invention.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000, preferably from about 5,000, more preferably from about 7,000 to 100,000, more preferably to 75,000, most preferably to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occuring subsequent to treatment with the soil release agent to be more easily cleaned in later washing procedures.

The following, all included herein by reference, describe soil release polymers suitable for use in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,771,730 Gosselink et al., issued Oct. 27, 1987; U.S. Pat.

No. 711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. Nos. 4,220,918; 4,787,989; EP 279,134 A, 1988 to Rhone-Poulenc Chemie; EP 457,205 A to BASF (1991); and DE 2,335,044 to Unilever N. V., 1974; all incorporated herein by reference.

Method of Use

The present invention further relates to a method for removing hydrophilic soils form fabric, preferably clothing, said method comprising the step of contacting fabric with an aqueous solution of a xyloglucanase enzyme containing composition wherein the aqueous concentration of said xyloglucanase is from about 0.5 ppm to about 50 ppm, said composition comprising:

a) from about 0.01% to about 10% by weight, of a zwitterionic polyamine which comprises a polyamine backbone, said backbone comprising two or more amino units wherein at least one of said amino units is quaternized and wherein at least one amino unit is substituted by one or more moieties capable of having an anionic charge wherein further the number of amino unit substitutions which comprise said anionic moiety is less than or equal to the number of quaternized backbone amino units;

b) from about 0.00005% to about 0.005% by weight, of a xyloglucanase enzyme;

c) from about 0.5% to about 50% by weight, of a surfactant system comprising:

i) from about 10% to about 99% by weight, of said surfactant system, of a nonionic surfactant;

ii) from about 1% to about 90% by weight, of said surfactant system, of an anionic surfactant;

iii) optionally, from 1% to about 50% by weight, of said surfactant system, of a detersive surfactant selected from the group consisting of cationic surfactants, zwitterionic surfactants, ampholytic surfactants, and mixtures thereof; and d) the balance carriers and adjunct ingredients.

Preferably the aqueous solution comprises at least about 0.01%, preferably at least about 1% by weight, of said laundry detergent composition.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

TABLE I

| Ingredients | weight % | | |
|---|---|---|---|
| | 2 | 3 | 4 |
| Sodium $C_{12}$–$C_{15}$ alcohol ethoxy (1.25) sulfate[1] | 18 | 18 | 18 |
| Linear alkylbenzene sulphonate | 5.8 | 5.8 | 5.8 |
| $C_8$–$C_{10}$ amide nonionic surfactant[2] | 1.17 | 1.4 | 1.4 |
| $C_{12}$–$C_{14}$ alkyl ethoxy (7.0) alcohol[3] | 4.1 | 2.8 | 2.8 |
| Builder | 12.6 | 11 | 11 |
| Xyloglucanase[4] | 0.03 | 0.03 | 0.03 |
| Protease[5] | 0.74 | 0.74 | 0.74 |
| Amylase[6] | 0.072 | 0.072 | 0.072 |
| Amylase[7] | 0.144 | — | — |
| Amylase[8] | — | 0.105 | 0.105 |
| Cellulase[9] | 0.028 | 0.028 | 0.028 |
| Cellulase[10] | 0.12 | — | — |
| Lipolase[11] | 0.06 | — | — |
| Mannanase[12] | — | 0.28 | 0.28 |
| Boric acid[13] | 2 | 2 | 2 |
| Ca formate/$CaCl_2$ | 0.02 | 0.02 | 0.02 |
| Dispersant[14] | 0.65 | 0.90 | — |
| Dispersant[15] | 0.68 | 0.70 | 0.7 |
| Soil Release Polymer[16] | 0.147 | — | — |
| Polyamine[17] | 1.5 | 2.0 | 1.4 |
| Chelant[18] | 0.61 | 0.30 | 0.3 |
| Chelant[19] | 0.35 | 0.35 | 0.35 |
| Optical brightener[20] | 0.144 | 0.144 | 0.144 |
| Minors[21] | balance | balance | balance |

[1]Can comprise either linear or mid-chain branched alkyl units.
[2]3-N'-($C_8$–$C_{10}$ branched alkanoyl)-N,N-dimethyl-1,3-diaminopropane.
[3]NEODOL 24-7 ex Shell Oil Co.
[4]Xyloglucanase enzyme available ex Novo.
[5]Protease enzyme from *Bacillus Amyloliquefaciens* as described in EP 0 130 756 B1 published January 9, 1985.
[6]Termamyl ® available ex Novo.
[7]Duramyl ® available ex Novo.
[8]Natalase ® ex Novo as described in WO 95/26397 and WO. 96/23873.
[9]Carezyme ® available ex Novo.
[10]Endo A ® available ex Novo.
[11]Lipolase Ultra available ex Novo.
[12]Mannanase enzyme originating from Bacillus sp. 1633 available ex Novo, 2.5% active
[13]As part of an enzyme stabilizing system.
[14]PEI 189 E15–E18 according to U.S. Pat. No. 4,597,898 Vander Meer, issued July 1, 1986.
[15]Ethoxylated Polyalkylene Dispersant: PEI 600 E20.
[16]Dimethylterephthalate, 1,2-propylene glycol, methyl capped PEG co-polymer according to U.S. Pat. No. 4,702,857 Gosselink, issued October 27, 1987.
[17]Zwitterionic polymer according to Example 1.
[18]Diethylene triamine penta(methyl phosphonic) acid (DTPMP).
[19]Hydroxyethanedimethylenephosphonic acid
[20]FWA-36.
[21]Minors include, inter alia, ethanol, 1,2-propanediol, methyl ethyl amine, sodium hydroxide, suds suppressers, dyes, perfumes, pro-perfumes, and opacifiers.

What is claimed is:

1. A liquid laundry detergent composition comprising:

a) from about 0.01% to about 10% by weight, of a zwitterionic polyamine having the formula

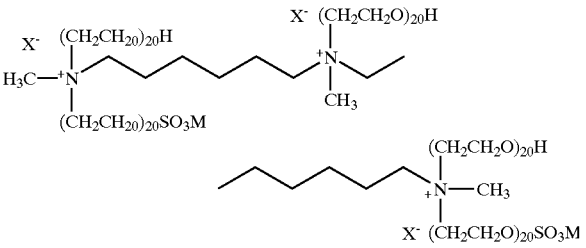

wherein X is a water soluble anion and M is hydrogen, a water-soluble cation, or mixtures thereof b) from about 0.00005% to about 0.005% by weight, of a xyloglucanase enzyme;

c) from about 0.5% to about 50% by weight, of a surfactant system comprising:

i) from about 10% to about 99% by weight, of said surfactant system, of a nonionic surfactant;

ii) from about 1% to about 90% by weight, of said surfactant system, of an anionic surfactant;

iii) optionally, from 1% to about 50% by weight, of said surfactant system, of a detersive surfactant selected from the group consisting of cationic surfactants, zwitterionic surfactants, ampholytic surfactants, and mixtures thereof; and d) the balance carriers and adjunct ingredients.

2. A composition according to claim 1 comprising from about 0.1% to about 5% by weight, of said zwitterionic polyamine.

3. A composition according to claim 2 comprising from about 0.5% to about 3% by weight, of said zwitterionic polyamine.

4. A composition according to claim 3 comprising form about 1% to about 2% by weight, of said zwitterionic polyamine.

5. A composition according to claim 1 comprising form about 0.0001% to about 0.001% by weight, of said xyloglucanase enzyme.

6. A composition according to claim 1 wherein said surfactant system comprises:

i) from about 20% to about 50% by weight, of said surfactant system, one or more nonionic surfactants selected from the group consisting of linear alkyl ethoxy alcohols, mid-chain branched ethoxy alcohols, alkyl polysaccharides, and mixtures thereof;

ii) from about 50% to about 80% by weight, of said surfactant system, one or more anionic surfactants selected from the group consisting of linear alkyl sulfates, mid-chain branched alkyl sulfates, linear alkyl ethoxy sulfates, mid-chain branched alkyl ethoxy sulfates, linear alkyl benzene sulphonates, and mixtures thereof.

7. A composition according to claim 1 further comprising from 0.00005% to about 0.005% by weight, of one or more enzymes selected from the group consisting of protease enzymes, amylase enzymes, cellulase enzymes, lipolase enzymes, lipase enzymes, mannanase enzymes, peroxidase enzymes, cutinase enzymes, and mixtures thereof.

8. A composition according to claim 7 comprising from about 0.0001% to about 0.001% by weight, of said mannanase enzyme.

9. A liquid laundry detergent composition comprising:

a) from about 0.01% to about 10% by weight, of a zwitterionic polyamine wherein said zwitterionic polyamine has the formula:

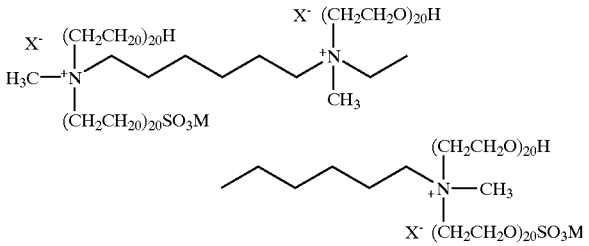

wherein X is a water soluble anion and M is hydrogen, a water-soluble cation, or mixtures thereof;

b) from about 0.00005% to about 0.005% by weight, of an enzyme system, said system comprising:

i) from about 20% to about 99% by weight, of said enzyme system, a xyloglucanase enzyme;

ii) from about 1% to about 80% by weight, of said enzyme system, a mannanase enzyme;

c) from about 0.5% to about 50% by weight, of a surfactant system comprising:

i) from about 10% to about 99% by weight, of said surfactant system, of a nonionic surfactant;

ii) from about 1% to about 90% by weight, of said surfactant system, of an anionic surfactant;

iii) optionally, from 1% to about 50% by weight, of said surfactant system, of a detersive surfactant selected from the group consisting of cationic surfactants, zwitterionic surfactants, ampholytic surfactants, and mixtures thereof; and d) the balance carriers and adjunct ingredients.

10. A composition according to claim 9 further comprising from 1% to 80% by weight, of said enzyme system one or more enzymes selected from the group consisting of protease enzymes, amylase enzymes, cellulase enzymes, lipolase enzymes, lipase enzymes, peroxidase enzymes, cutinase enzymes, and mixtures thereof.

11. A composition according to claim 9 further comprising from 1% to 80% by weight, of a builder.

12. A method for treating fabric in need of cleaning, said method comprising the step of contacting fabric with an aqueous solution of the detergent composition of claim 1.

* * * * *